United States Patent [19]

Muegerl

[11] Patent Number: 5,020,190

[45] Date of Patent: Jun. 4, 1991

[54] ANTI-LIFT AND ANTI-TWIST HINGE

[75] Inventor: Gerard J. Muegerl, Goshen, Ind.

[73] Assignee: Universal Cooperatives, Inc., Minneapolis, Minn.

[21] Appl. No.: 371,384

[22] Filed: Jun. 26, 1989

[51] Int. Cl.[5] ..... E05D 5/12; E05D 5/02

[52] U.S. Cl. ..... 16/380; 16/253

[58] Field of Search ..... 16/380, 252, 253, 257, 16/262; 248/289.1, 297.5, 296

[56] References Cited

U.S. PATENT DOCUMENTS

| | | | |
|---|---|---|---|
| 1,151,920 | 8/1915 | Barton | 248/296 |
| 3,811,149 | 5/1974 | Griffin | 16/253 |
| 4,079,481 | 3/1978 | Cacicedo | 16/253 |

FOREIGN PATENT DOCUMENTS

| | | | |
|---|---|---|---|
| 2342703 | 3/1974 | Fed. Rep. of Germany | 403/406 |

*Primary Examiner*—Richard K. Seidel
*Assistant Examiner*—Carmine Cuda
*Attorney, Agent, or Firm*—James D. Hall

[57] ABSTRACT

An anti-lift/anti-twist hinge which includes a bracket having a wall and a pair of spaced converging flanges. The flanges have aligned openings therein for accommodating a hinge pin. The hinge bracket is attached to a gate and prevents the upward rooted or rubbed shifting of the gate and bracket by the interfering fit between the pin and bracket. When tightened against the gate the bracket flattens a side wall of the supporting gate tube to prevent twisting of the bracket relative to the tube.

3 Claims, 3 Drawing Sheets

ANTI-LIFT AND ANTI-TWIST HINGE

SUMMARY OF THE INVENTION

This invention relates to a gate hinge and will have specific relevance to an anti-lift/anti-twist gate hinge.

It is typical in the livestock industry to provide an entrance gate for an animal confinement area. It is further common that the animals confined within the area will rub, root or otherwise press against the gate. Heretofore, gate hinges have been formed such that as the animal rubs or roots against the gate, the gate may be raised and possibly lift the hinge pin out of its bracket. Further, as the animal rubs or roots against the gate, the bottom hinge will twist around on the round gate tube. This twisting of the hinges causes the end of the gate to drop and thus makes it difficult to open the gate. This invention eliminates the problems previously encountered by providing a hinge bracket which inhibits upward movement of the gate relative to the hinge pin and deforms the round gate tube during installation to prevent twisting movement of the hinge relative to the gate.

Accordingly, it is an object of this invention to provide for a novel gate hinge.

Another object of this invention is to provide for a gate hinge which inhibits shifting of the hinge pin relative to the hinge bracket.

Another object of this invention is to provide for a novel gate hinge which prevents shifting of the hinge relative to the gate post.

Other objects of this invention will become apparent upon a reading of the following description taken with the accompanying drawings.

DESCRIPTION OF THE PREFERRED EMBODIMENT

The preferred embodiment herein described is not intended to be exhaustive or to limit the application to the precise forms disclosed. Rather it is chosen and described so that others skilled in the art can utilize its teachings.

Figure 3:
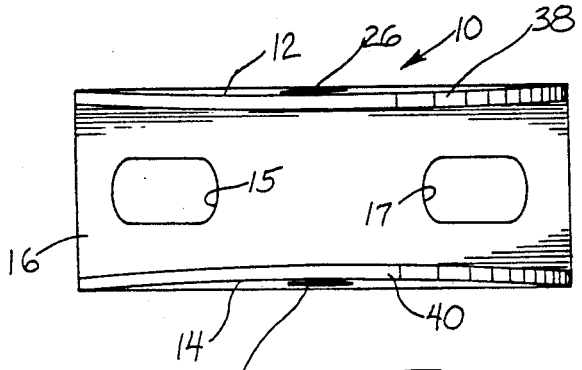
FIG. 3 is a front view of the hinge bracket.
Figure 2:
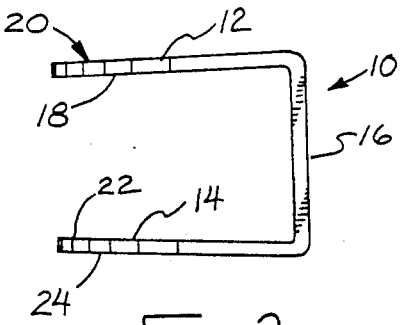
FIG. 2 is an end view of the hinge bracket.
Figure 1:
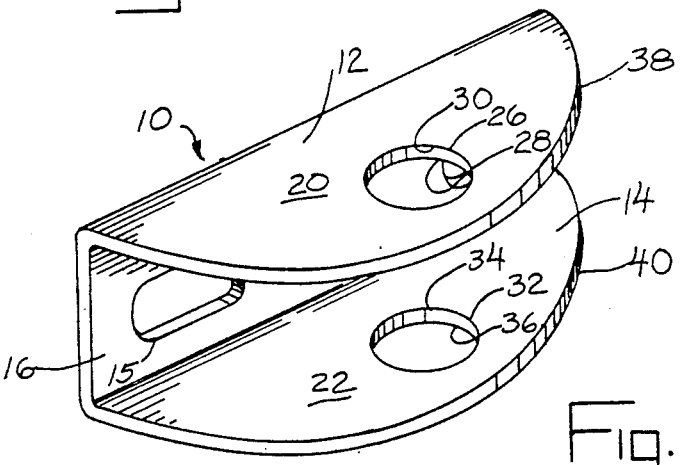
FIG. 1 is a perspective view of the hinge bracket of the invention.

Referring now to FIGS. 1–3, hinge bracket 10 is of one-piece construction and includes a wall 16 and protruding spaced flanges 12, 14 which define a substantially C-shaped structure when viewed in cross-section. Wall 16 has spaced slots 15 and 17.

Figure 5:
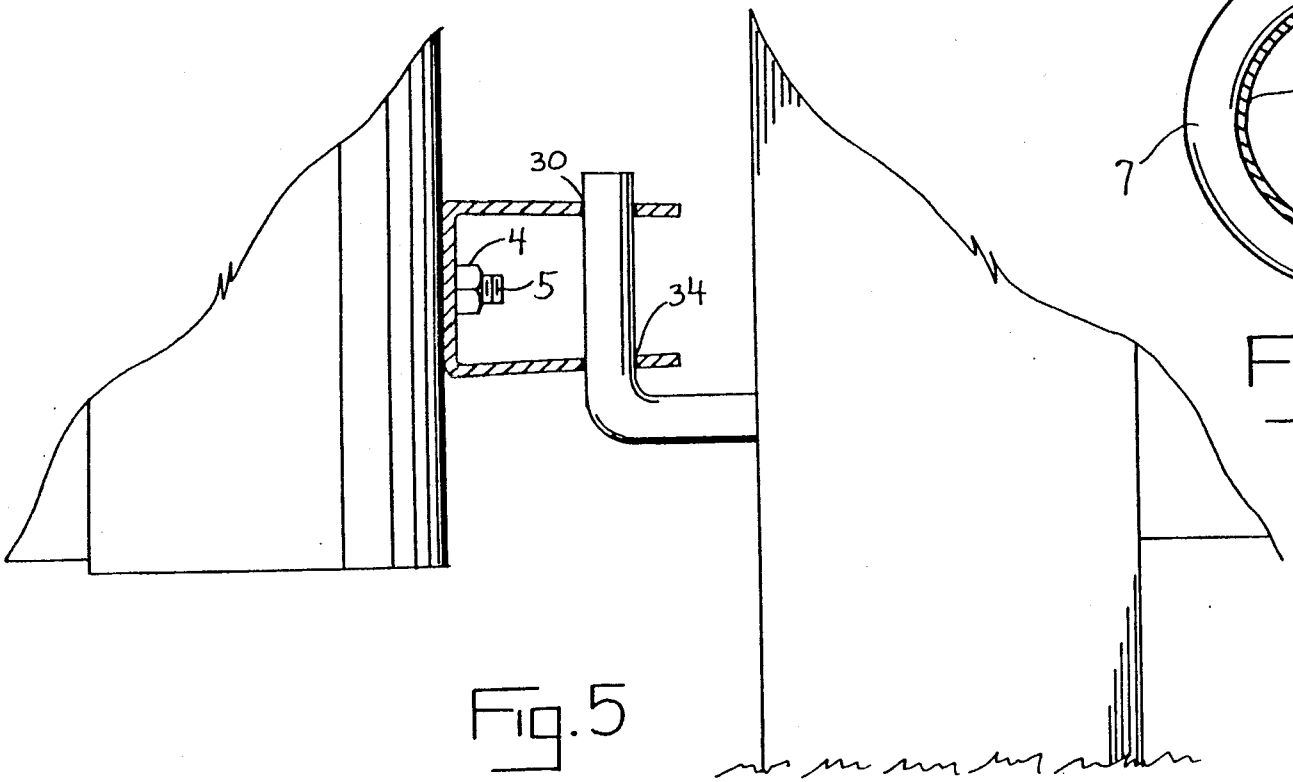
FIG. 5 is a fragmented sectional view taken along line 5—5 of FIG. 4.

Flanges 12 and 14 are in-turned and converge as illustrated in FIGS. 2 and 5. Flange 12 has an inner surface 18 and an outer surface 20. Likewise flange 14 has an inner surface 22 and an outer surface 24. Flange 12 has an opening 26 which extends from outer surface 20 to inner surface 18. Opening 26 is defined by inner edge 28 at surface 18 and by outer edge 30 at surface 20.

Flange 14 has an opening 32 which extends from outer surface 24 to inner surface 22. Opening 32 is defined by inner edge 34 at surface 22 and by outer edge 36 at surface 24. In the preferred embodiment, flanges 12 and 14 have arcuate peripheral outer edges 38 and 40, respectively.

Figure 4:
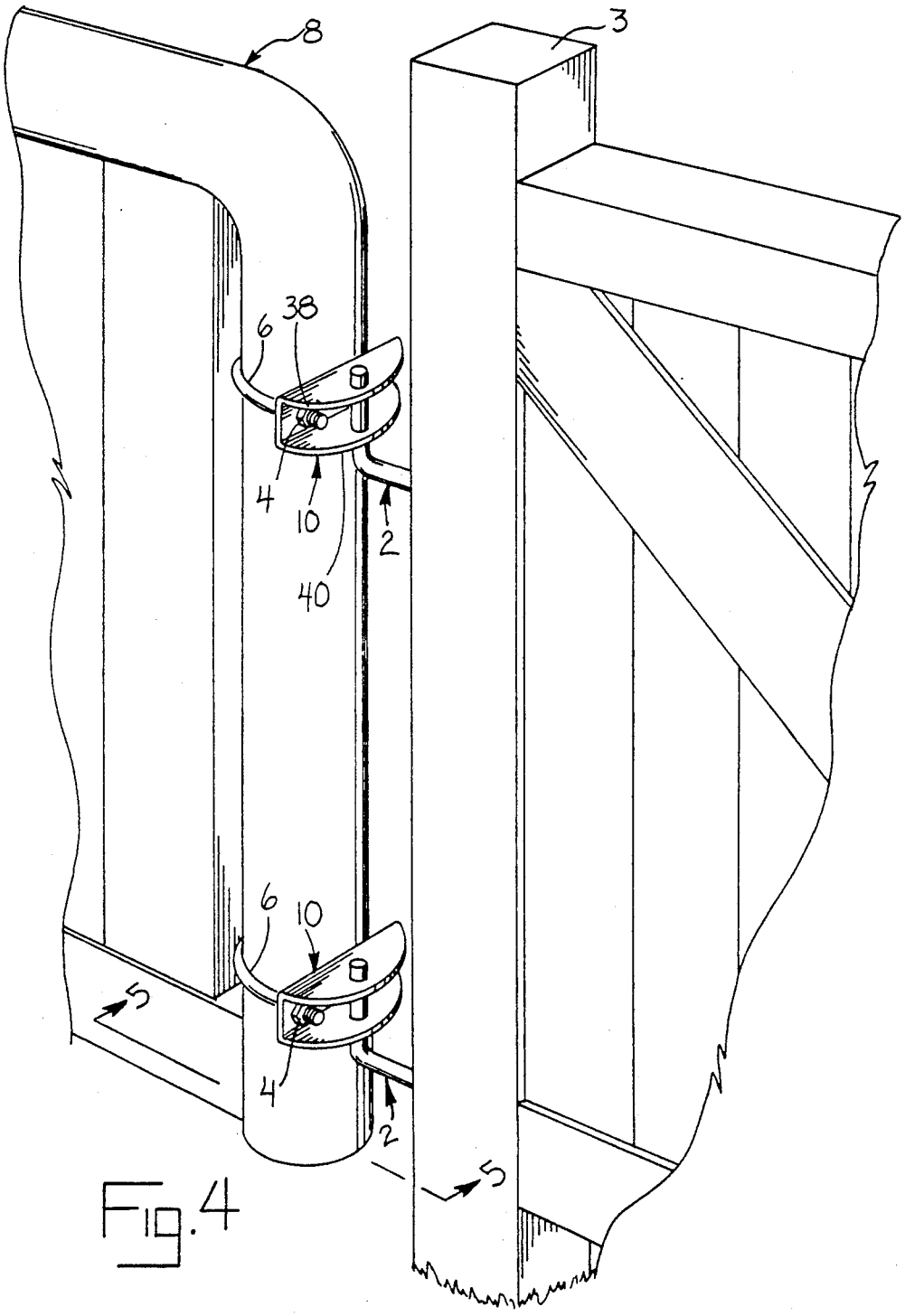
FIG. 4 is a fragmented perspective view of the hinge bracket shown in use on a gate.
Figure 6:
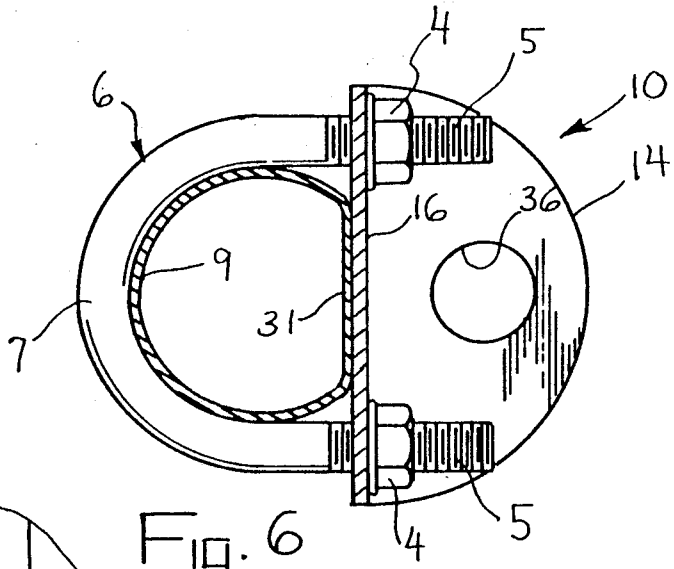
FIG. 6 is a cross sectional view taken along line 6—6 of FIG. 5.

As shown in FIGS. 4–6, two hinge brackets 10 are typically attached to a gate 8 by U-bolts 6 which have an intermediate portion 7 positioned around gate tube 9 and their threaded ends 5 protruding through slots 15, 17 of bracket wall 16. Nuts 4 are turned onto the U-bolt ends 5 against bracket wall 16. As illustrated in FIG. 6 when nuts 4 are tightened, bracket 10 deforms tube 9 forming a flattened side wall 31. The abutting flattened surfaces of walls 31 and 16 prevent bracket 10 from twisting around tube 9. L-shaped hinge pins 2 are connected to a gate post 3 in a common manner, such as by being screwed into or bolted through the post, so that hinge pin 2 pivot upwardly. Gate 8 with hinge brackets 10 attached is pivotally connected to post 3 by the accommodation of each pin 2 within openings 18 and 20 of a bracket. The arcuate peripheral edges 38, 40 of brackets 10 permit gate 8 to pivot about hinge pins 2 without interference. When an animal pushes or roots up against gate 4 the gate and brackets 10 are prevented or at least inhibited from shifting upwardly as observed in FIG. 5. Due to the converging taper of bracket flange 12 and 14, pin 2 experiences an interference fit within bracket openings 26 and 32. Portions of the edges 28, 30, 34, or 36 of openings 26 and 32 in effect bite into pin 2 to prevent upward progression of the bracket.

It should be understood that this invention is not to be limited to the precise details above but may be modified within the scope of the appended claims.

I claim:

1. In a pivoting gate structure, a hinge consisting of an elongate, one-piece U-shaped bracket and a L-shaped hinge pin pivotally connected by an interference fit to said bracket, said bracket including a generally planar wall having an outer surface engagingly secured to a support and spaced converging flanges rigidly extending from longitudinal edges of said wall, each flange having a medial opening through which said hinge pin extends, each opening being defined by inner and outer edges, a portion of said inner and outer edges constituting means for engaging said hinge pin as said bracket is shifted relative to the hinge pin to restrict the movement of said bracket relative to the pin a pair of spaces apart openings in said wall and a connection means for connection of said bracket to said support.

2. The gate structure of claim 1, wherein said support includes a gate tube, the planar bracket wall abuttingly connected to said gate tube by a generally U-shaped fastening device having an intermediate part extending around said tube and threaded leg parts projecting through said wall openings, a nut threaded upon each fastening device leg projecting part and turned forcibly against said planar bracket wall with said gate tube being deformed by said planar bracket wall until said gate tube includes a flat side wall and is generally D-shaped in cross section prevent rotation of said fastening device and said bracket relative to said gate tube.

3. The hinge of claim 1 wherein each flange has an arcuate peripheral outer edge.

* * * * *